US006550607B1

(12) United States Patent
Watson et al.

(10) Patent No.: US 6,550,607 B1
(45) Date of Patent: Apr. 22, 2003

(54) JAM DETECTION SYSTEM FOR A WAREWASHER

(75) Inventors: Michael Thomas Watson, Centerville, OH (US); David Charles Edelmann, Troy, OH (US)

(73) Assignee: Premark FEG L.L.C., Wilmington, DE (US)

( * ) Notice: Subject to any disclaimer, the term of this patent is extended or adjusted under 35 U.S.C. 154(b) by 48 days.

(21) Appl. No.: 09/704,861

(22) Filed: Nov. 2, 2000

(51) Int. Cl.[7] ..... B08B 3/00; B65G 43/02

(52) U.S. Cl. ..... 198/810.01; 198/810.04; 198/810.02; 134/56 D; 134/58 D; 134/57 D

(58) Field of Search ..... 198/810.01, 810.02, 198/810.04; 134/56 D, 57 D, 58 D

(56) References Cited

U.S. PATENT DOCUMENTS

| | | | |
|---|---|---|---|
| 1,637,376 | A | 8/1927 | Gibney |
| 2,151,354 | A | 3/1939 | Osuch |
| 2,702,042 | A | 2/1955 | Smith |
| 2,886,046 | A | 5/1959 | Du Gal |
| 3,106,217 | A | 10/1963 | Henderson |
| 3,832,870 | A | 9/1974 | Todd-Reeve |
| 3,978,875 | A | 9/1976 | Slany |
| 4,237,912 | A | 12/1980 | Hill et al. |
| 4,267,914 | A | 5/1981 | Saar |
| 5,311,894 | A | 5/1994 | Payzant |
| 6,056,667 | A | 5/2000 | Sasaki |

*Primary Examiner*—Christopher P. Ellis
*Assistant Examiner*—Mark A. Deuble
(74) *Attorney, Agent, or Firm*—Thompson Hine LLP

(57) ABSTRACT

A warewasher jam detection system includes a conveyor drive arrangement having a drive motor assembly including a drive motor and an output shaft, and a slip clutch including an input side moved via the output shaft and an output side operatively connected for driving a conveyor. At least one sensor is provided for producing an output indicative of movement/non-movement of the output side of the clutch. Preferably the sensor is a non-contact type sensor such as a magnetic sensor, optical sensor or proximity sensor. A controller may be provided for receiving the sensor output signals and identifying a jam condition based upon the same, such that the controller can responsively stop the drive motor.

28 Claims, 5 Drawing Sheets

JAM DETECTION SYSTEM FOR A WAREWASHER

FIELD OF THE INVENTION

The present invention relates generally to warewashers which are used in commercial applications such as cafeterias and restaurants, and, more particularly, to a system for detecting jams which may occur in such warewashers.

BACKGROUND OF THE INVENTION

Commercial warewashers commonly include a housing area which defines the washing and rinsing area for dishes, pots pans and other wares. A conveyor is used to transport the wares through the warewasher from an input side to an output side. At the output side of the warewasher a ware receiving table/trough may extend several feet to allow cleaned wares to exit from the warewasher completely before being removed by kitchen personnel.

One potential problem with such warewashers is that improperly loaded wares or ware racks can shift during conveyance through the warewasher to a position which causes a jam in the conveying system. In this type of jam condition the mispositioned ware or rack physically prevents movement of the conveyor, and damage to the warewasher itself can occur.

The prior art includes techniques which attempt to account for this jam condition. For example, as shown in FIG. 9, one prior art drive arrangement 200 includes a drive motor assembly 202 which is attached to a pivotable motor mount 204. The output of the drive motor assembly 202 is connected to a coupler 206 having a shaft 208 which extends through a bearing block 210 which is mounted to the tank shelf 211 (shown in dashed lines). The shaft 208 extends to a crank arm 212. As the crank arm 212 rotates in a clockwise direction (looking from top to bottom along the rotational axis) it repeatedly engages a drive block 214. The conveyor 216 includes a dog-type system that moves racks containing wares through the machine on tracks 218 in a stop and go fashion with every rotation of the crank arm 212. The dogs 220 are attached to a cradle 222 that is suspended below the tracks 218 on four plastic slider blocks 224. The cradle is made to oscillate back and forth in the direction of arrow 226 by the rotating crank arm 212 and drive block 214, propelling the racks forward on every forward stroke of the cradle 222. The drive block 214 runs in a channel formed by welding two L-shaped brackets together.

Anti-jam prevention is accomplished in the above-described prior art arrangement by mounting the entire drive motor assembly 202 on a pivot. The drive motor assembly 202 is mounted laterally to a movable motor mount 204. The location of the drive motor assembly 202 is normally fixed by use of a die spring 228 which exerts a force sufficient to prevent pivoting under normal, acceptable operating conditions. When the cradle 222 encounters a jam situation, the crank arm 212 is prevented from rotating, causing the drive motor assembly 202 to pivot in a counterclockwise direction (looking from top to bottom along the rotational axis) against the force of spring 228 opening the contacts of an anti-jam switch 230. When opened, the anti-jam switch 230 removes power from a contactor that then opens and removes power to the drive motor. The sensitivity of when the system trips is determined by setting of the die spring 228 and the setting of the anti-jam switch 230.

The above-described anti-jam arrangement may not operate properly if power to the drive motor is hooked up in reverse polarity, causing the drive motor to run counterclockwise instead of clockwise (looking from top to bottom along the rotational axis). When this type of misconnection occurs the drive motor assembly attempts to rotate clockwise when a jam situation occurs. Because such clockwise rotation is not possible, the anti-jam switch will not be activated, potentially resulting in damage to the drive arrangement. Further, even when powered for proper rotation, in a jam situation, due to the time necessary for the drive motor to come to a stop, excessive forces in the arrangement can potentially result in damage to the drive arrangement.

A second potential problem with such warewashers is the build up of excess wares at the outlet end of the warewasher when kitchen personnel fail to remove cleaned wares in a timely fashion. The ware receiving table at the outlet end may include sidewalls and an end wall which prevents wares from tumbling onto the floor. However, if the wares are not removed quickly a back-up can occur in which wares exiting the warewasher may begin to collide with non-removed wares which are abutting against the end wall. This back-up type jam can result in undesired damage to the wares. Attempts to address this type of jam condition include the use of a table limit switch at the end of the ware receiving table which is triggered when wares exiting the warewasher reach the end of the table. Triggering of the switch then cuts power to the drive motor. However, some operators do not use the limit switch option, and instead attempt to rely on the anti-jam switch described above, which includes its own set of problems as previously noted.

Accordingly, it would be desirable to provide a warewasher jam detection system which addresses the aforementioned problems.

SUMMARY OF THE INVENTION

In one aspect of the present invention, a warewasher jam detection system includes a conveyor drive arrangement having a drive motor assembly including a drive motor and an output shaft, and a rotatable slip clutch including an input side operatively connected for rotation by the drive motor assembly output shaft, an output side of the rotatable slip clutch operatively connected for driving a conveyor. At least one sensor is provided for producing an output indicative of rotation/non-rotation of the output side of the rotatable slip clutch, wherein non-rotation of the output side during rotation of the input side indicates a jam condition. Preferably the sensor is a non-contact type sensor such as a magnetic sensor, optical sensor or proximity sensor. A controller may be provided for receiving the sensor output signals and identifying a jam condition based upon the same, such that the controller can responsively stop the drive motor.

In one preferred arrangement the system may include at least a first sensor and a second sensor for detecting rotation/non-rotation of the output side of the rotatable slip clutch, with a defined spacing between the first and second sensors. First and second sensor tripping elements are positioned to the output side of the slip clutch, each positioned for tripping the first and second sensor when aligned therewith respectively. A spacing between the first and second sensor tripping elements is different than the defined spacing of the first and second sensors for preventing simultaneous tripping of the first and second sensors.

Still a further aspect of the invention provides a method of detecting a jam condition in a warewasher including a drive motor for driving a conveyor, where the method involves providing a slip clutch between the drive motor and the conveyor. A slip threshold of the slip clutch is set at a level to identify jam conditions and a sensor arrangement is provided for producing an output indicative of a movement state of an output side of the clutch. A jam condition is identified based upon the output produced by the sensor arrangement.

DETAILED DESCRIPTION OF THE EMBODIMENTS

Figure 1:
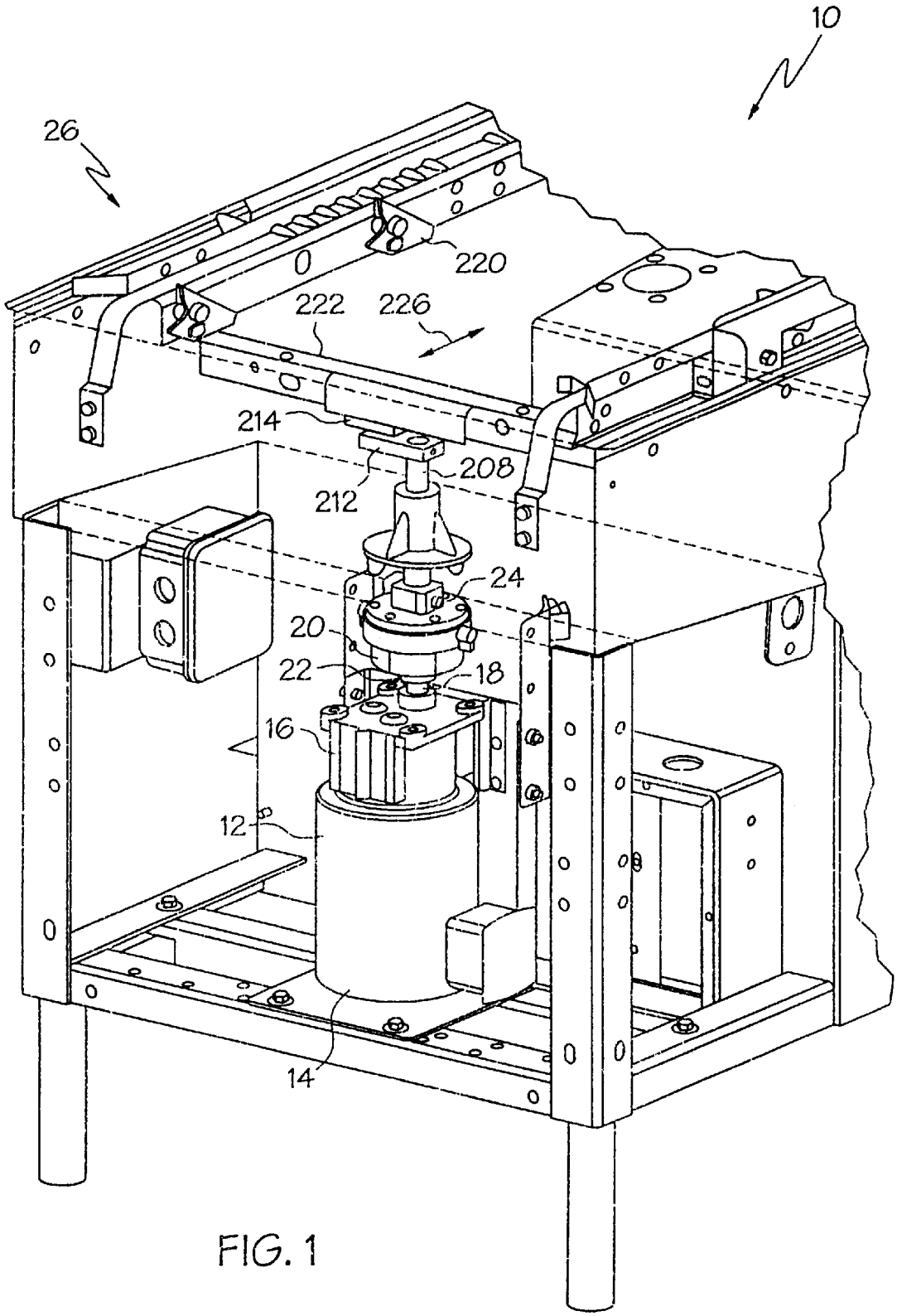
FIG. 1 is a perspective view of a jam detection system according to one embodiment of the invention.
Figure 9:
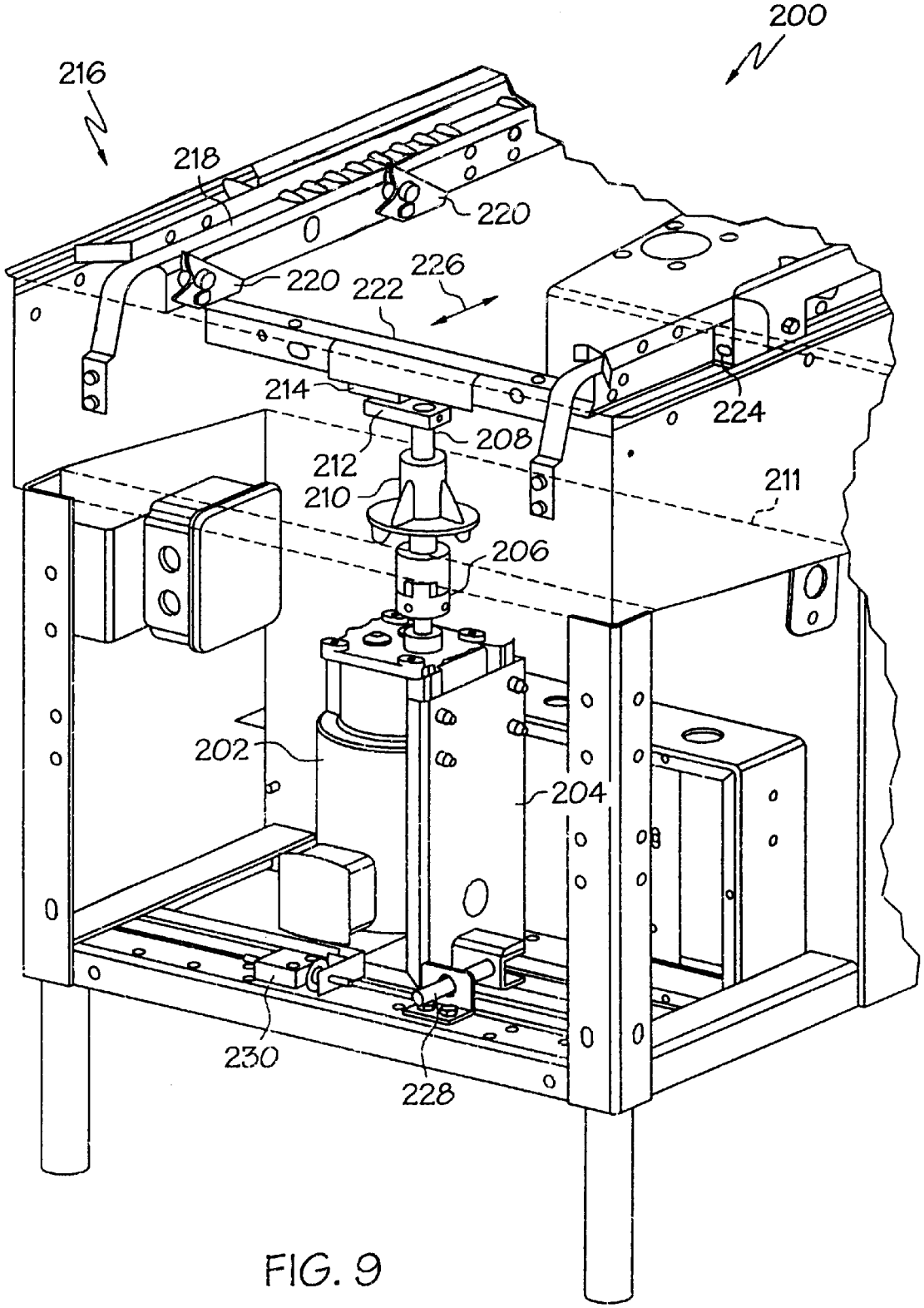
FIG. 9 is a perspective view of a prior art warewasher drive arrangement.

Referring to drawing FIG. 1, one embodiment of a warewasher jam detection system 10 is illustrated and includes a conveyor drive arrangement including a drive motor assembly 12 formed by a drive motor 14 and reduction gear box 16. The drive motor assembly 12 includes a rotating output shaft 18. A rotatable slip clutch 20 includes an input side 22 operatively connected for rotation by the drive motor assembly output shaft 18, and an output side 24 which is operatively connected for driving a conveyor 26 such as that described above with reference to FIG. 9. However, it is recognized that the type of conveyor which is driven by the motor, gear box, slip clutch combination could vary widely. For example, in some machines a continuous conveyor belt or continuous plastic conveyor with slots for receiving wares may be provided. Regardless of the nature of the conveyor, the use of the rotatable slip clutch 20 facilitates detection of jam conditions as will be described in greater detail below.

With respect to rotatable slip clutch 20, the type of slip clutch utilized could vary. For example, a friction clutch, sprag clutch, a detent clutch or other rotating slip clutch could be utilized. Accordingly, the term "rotatable slip clutch" as used herein is intended to broadly encompass a device in which an input member and an output member are configured to rotate with each other when a torque applied from the input member to the output member to impart rotation of the output member is below a set threshold, and in which the input member rotates relative to the output member when the torque applied from the input member to the output member to impart rotation of the output member meets or exceeds the set threshold. The term "slip clutch" as used herein is intended to broadly encompass a device in which an input member and an output member are configured to move with each other when a force applied from the input member to the output member to impart movement of the output member is below a set threshold, and in which the input member moves relative to the output member when the force applied from the input member to the output member to impart movement of the output member meets or exceeds the set threshold, and is inclusive of a rotatable slip clutch as well as linear, reciprocal and other non-rotatable slip clutches. In preferred arrangements the torque or force threshold of the slip clutch can be easily adjusted.

Figure 2:
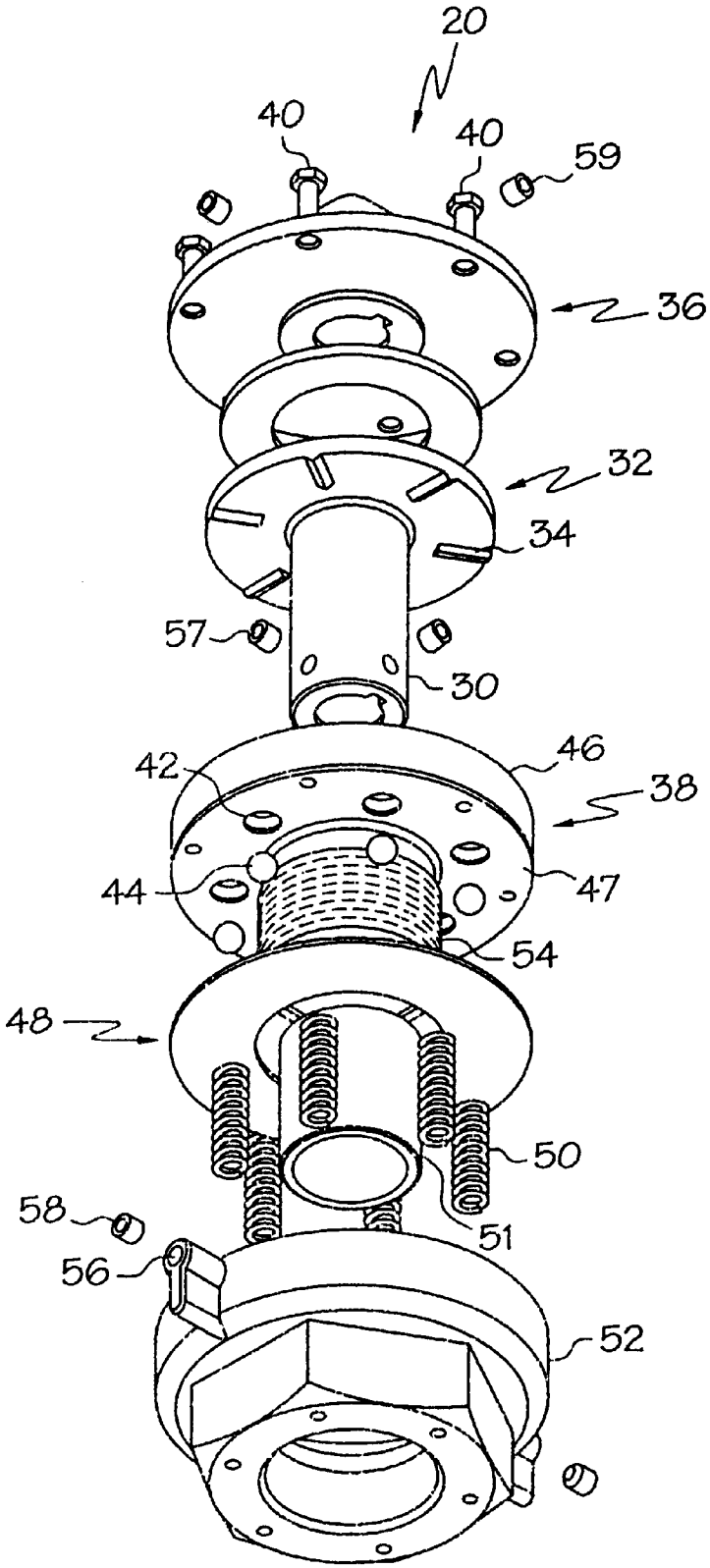
FIG. 2 is an exploded view of a detent type slip clutch.
Figure 3:
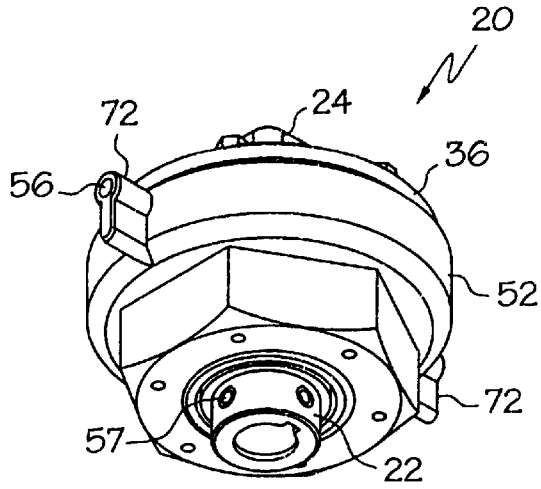
FIG. 3 is an assembled view of the slip clutch of FIG. 2.

In this regard, reference is made to FIGS. 2 and 3 which illustrate a preferred rotatable slip clutch construction of the detent type useful in connection with the jam detection system 10. The subject rotatable slip clutch 20 includes input side 22 which is formed by a protruding boss 30 of detent hub 32. The detent hub 32 includes a plurality of radial detents 34 formed therein at equally spaced intervals. The detent hub 32 is positioned between a plate 36 and a carrier 38, with the plate 36 being fixed to the carrier 38 via bolts 40. The carrier 38 includes plurality of holes 42 which receive respective ball bearings 44. The bearings 44 are sized to protrude slightly above the upper surface 46 of the carrier when a reaction plate 48 is positioned against lower surface 47. An upward force is exerted on the reaction plate 48 by springs 50 which are compressed between the plate 48 and an internal surface of an adjustment nut 52. The adjustment nut 52 threads onto a threaded hub 54 which extends from the carrier 38. A bushing 51 is also provided between an internal surface of hub 54 and the outer surface of boss 30.

In operation, an input shaft is connected to input side 22 using set screws 57 & key and an output shaft is connected to output side 24 using set screws 59 & key. The output side 24 is formed by a boss for receiving a shaft. The ball bearings 44 are seated in the detents 34 such that rotation of the detent hub 32 causes corresponding rotation of the carrier 38 and the fixed plate 36 attached thereto, resulting in rotation of the output side 24. When the torque applied to the input side 22 exceeds a set threshold, the ball bearings slide relative to the detents 34 and move downward into the holes 42 moving the plate 48 against the springs. When this occurs the detent hub 32 will rotate relative to the carrier 38 and fixed plate 36, resulting in non-rotation of the output side 24 of the rotatable slip clutch 22. The torque threshold can be easily adjusted by rotating the adjustment nut 52 relative to fixed plate 36 and carrier 38 attached thereto in order to vary the distance between the adjustment nut 52 and reaction plate 48. Varying such distance varies the compression force on the springs 50 and thus the force required for the ball bearings 44 to move out of the detents. Radial openings 56 in the adjustment nut 52 and set screws 58 are provided for fixing the position of the adjustment nut 52 relative to the carrier 38.

Thus, the use of the above-described rotatable slip clutch 20 in the conveyor drive arrangement facilitates setting a jam indication threshold by adjusting the torque threshold of the rotatable slip clutch 22. The appropriate torque threshold can be set to identify jams caused by mispositioned wares, racks or other physical jams, as well jams caused by back ups at the exit side of the warewasher. Further, a sensor arrangement may be provided for detecting jam conditions as described below.

Figure 4:
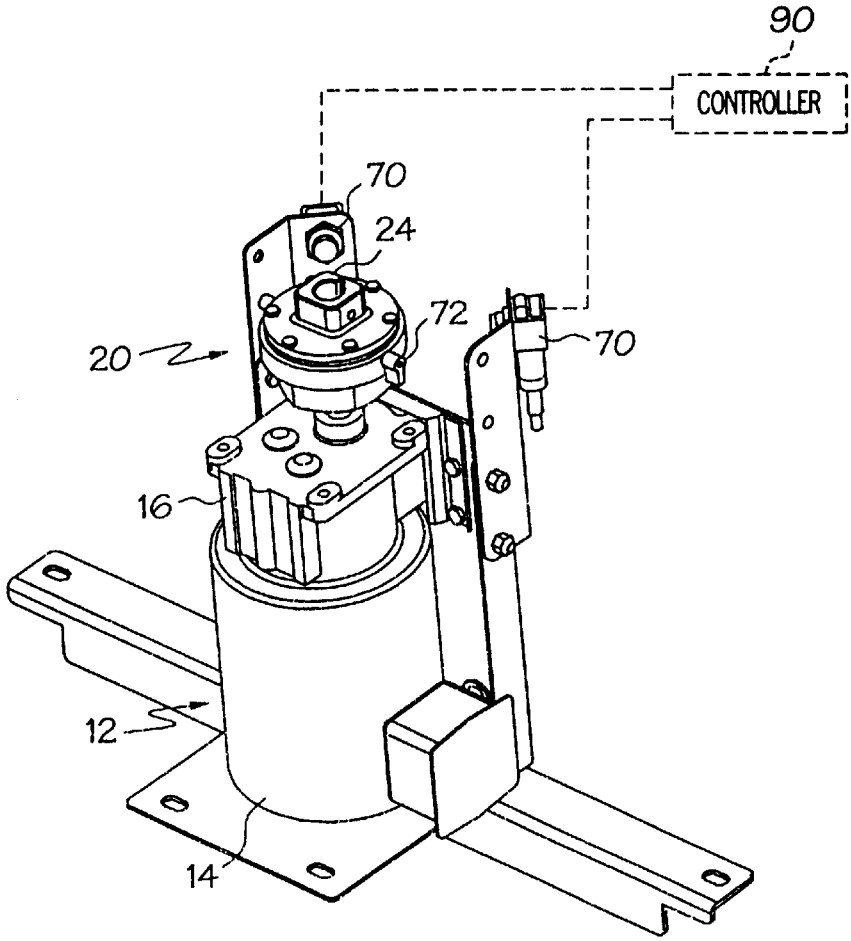
FIG. 4 is an enlarged view of the sensor arrangement of the detection system of FIG. 1.

Referring to FIG. 4, in one contemplated embodiment the sensor arrangement includes spaced apart sensors 70 which are used to detect spaced apart sensor tripping elements 72 which rotate with the output side 24 of the rotatable slip clutch 20. In the illustrated embodiment sensors 70 are proximity sensors and the sensor tripping elements 72 are tabs or other protrusions positioned to pass within a sensing field of the sensors 70 when circumferentially aligned therewith. However, it is recognized and anticipated that other types of sensors and sensor tripping elements could be used.

Figure 5:
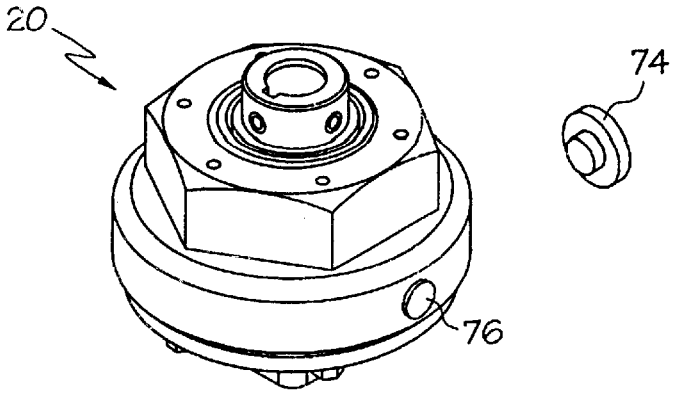
FIGS. 5, 6 and 7 depict alternative sensor arrangements.
Figure 6:
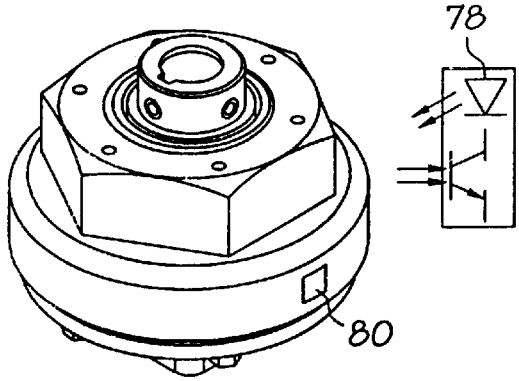
Figure 7:
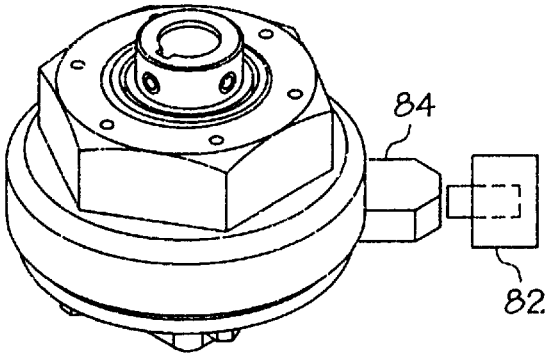

For example, reference is made to FIGS. 5, 6, and 7 where other arrangements are shown. FIG. 5 shows the use of a magnetic type sensor 74 in combination with a magnet (or magnets) 76 positioned on the rotatable slip clutch 20 as a sensor tripping element. Magnetic sensor 74 could comprise a Hall effect type sensor or a magnetic reed switch. FIG. 6 illustrates the use of an optical type sensor 78 in combination with a defined image area 80 on the rotatable slip clutch 20 as a sensor tripping element. FIG. 7 illustrates the use of a contact, push-button type switch 82 in combination with a projection 84 as a sensor tripping element, where the projection 84 includes cam surfaces for engaging the switch 82 as the rotatable slip clutch rotates. Other types of sensors and sensor tripping elements could likewise be used, although the non-contact type such as that shown in FIGS. 4, 5 and 6 is preferred.

Figure 8:
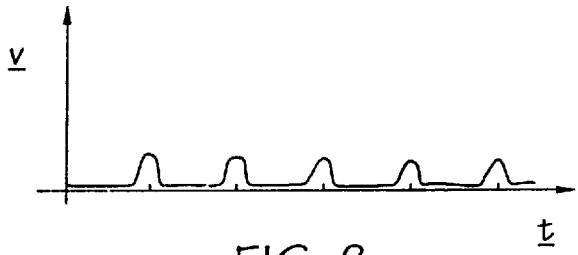
FIG. 8 shows a representative sensor output signal.

Referring again to FIG. 4, the proximity sensors 70 may each output a pulse signal when the projection 72 is within its sensing field such that for a constant rotating speed of the rotatable slip clutch 20, the sensor output signal would look generally as shown in FIG. 8. A controller 90 associated with the proximity sensors 70 monitors the sensor output to identify whether the output side of the rotatable slip clutch 20 is rotating. If the controller determines that the output side is not rotating, then a jam condition identification is made and the controller 90 can shut off power to the drive motor 14, and may also set an alarm (such as a warning light or horn/buzzer) to alert the operator that a problem exists.

It is contemplated that a single sensor 70 could be utilized in combination with one or more sensor tripping elements. In such cases, the controller monitors the sensor output and when the duration since a last pulse signal exceeds a set duration threshold, the jam condition identification is made. Where the preferred detent type slip clutch is used, it is possible that a jam condition may occur when the sensor tripping element 72 is aligned with the sensor 70. Because of the nature of the detent clutch, each time the ball bearings 44 align with and seat in the detents 34 during slip, the output side of the rotatable slip clutch 20 will receive an amount of torque sufficient to cause a jerking movement of the output side of the rotatable slip clutch 20 and its associated sensor tripping element(s) 72. In such situations, the pulses output by the sensor 70 may actually increase in frequency. The controller 90 should therefore preferably be configured to identify a jam condition both when the duration between successive pulses is too fast and when the duration between successive pulses is too slow. Accordingly, an acceptable duration window may be established and stored in memory. If the monitored duration between successive pulses falls outside the established window, a jam condition will be identified. Because the drive system may operate at varying speeds, the duration window established for one drive speed may vary from the window established for another drive speed, requiring that multiple duration windows be stored in memory for selective use by the controller 90 according to the speed setting of the warewasher.

Where two sensors 70 are used the need for use of an acceptable duration window can be eliminated by using two sensors 70 and one tripping element 72, or by setting a spacing between the sensors 70 which is sufficiently different than a spacing between multiple tripping elements 72 to prevent both sensors 70 from being tripped at the same time. In either arrangement, when the duration since a last pulse signal of either sensor 70 exceeds a set threshold, the controller 90 identifies a jam condition.

Regardless of the sensor/sensor tripping element arrangement used, a method of detecting a jam condition in a warewasher including a drive motor for driving a conveyor is provided, where the method involves providing a slip clutch between the drive motor and the conveyor, the slip clutch including an input side toward the drive motor and an output side toward the conveyor; setting a slip threshold of the slip clutch at a level to identify jam conditions; providing a sensor arrangement for producing an output indicative of a movement state of the output side of the clutch; and identifying a jam condition based upon the output produced from the sensor arrangement. The slip threshold can be set according to testing of a given machine, and may be set at manufacture or on site at the time of warewasher set up and installation.

Although the invention has been described and illustrated in detail it is to be clearly understood that the same is intended by way of illustration and example only and is not intended to be taken by way of limitation. For example, while the use of one or more sensors to monitor rotation of a portion of the slip clutch itself is illustrated herein, it is recognized and anticipated that one or more sensors could be positioned to monitor movement of any portion of the conveyor drive or conveyor itself which is located to the output side of the slip clutch. For example, a suitable sensor arrangement could be positioned for detecting rotation of the shaft 208 or the crank arm 212 as an indicator of the movement state of the output side of the slip clutch in order to identify jam conditions. Further, reciprocal movement of the dogs 220 or other portion of the cradle 222 could likewise be monitored with a suitable sensor arrangement as an indication of whether the output side of the slip clutch is moving. Accordingly, as used herein the terminology "sensor for producing an output indicative rotation/non-rotation of the output side of the slip clutch" and "sensor for producing an output indicative movement/non-movement of the output side of the slip clutch" is intended to encompass any sensor which senses movement of any structure which moves when the output side of the slip clutch moves and does not move when the output side of the slip clutch does not move. Further, as used herein a structure is considered to move with the output side of the slip clutch if movement of the output side causes the structure to move, regardless of whether the structure moves in a rotational manner.

It is further possible, particularly when monitoring a linear or reciprocal movement, that the sensor could be located on the moving part for movement therewith, and the sensor tripping element could be stationary. Accordingly, as used herein the terminology "to the output side of the slip clutch" when referring to one or more sensors is intended to broadly encompass positioning of the sensor to monitor movement of any portion of the conveyor drive or conveyor itself which moves as the output side of the slip clutch moves, including positioning of the sensor on the monitored portion for movement therewith and stationary positioning of the sensor adjacent the monitored portion. Similarly, as used herein the terminology "to the output side of the slip clutch" when referring to one or more sensor tripping elements is intended to broadly encompass positioning of the same in association with any movable portion, including on the movable portion for movement therewith or stationary positioning adjacent the movable portion.

Accordingly, the spirit and scope of the invention are to be limited only by the terms of the appended claims.

What is claimed is:

1. A warewasher jam detection system, comprising:

a conveyor drive arrangement including:

a drive motor assembly including a drive motor and an output shaft;

a rotatable slip clutch including an input side operatively connected for rotation by the drive motor assembly output shaft, an output side of the rotatable slip clutch operatively connected for driving a conveyor;

at least one sensor for producing an output indicative of rotation/non-rotation of the output side of the rotatable slip clutch;

wherein non-rotation of the output side during rotation of the input side indicates a jam condition.

2. The system of claim 1, further comprising:

a controller associated with the sensor for receiving the output therefrom, the controller operable to identify a jam condition based upon the received output and, in response to identification of a jam condition, to stop the drive motor.

3. The system of claim 2 wherein the controller monitors a timing between sensor trip signals received from the sensor and identifies a jam condition if the timing between sensor trip signals falls outside an established time window.

4. The system of claim 2, wherein the controller cuts power to the drive motor in response to identification of a jam condition.

5. The system of claim 1, wherein the at least one sensor comprises at least one magnetic sensor spaced from a trip portion of the output side of the rotatable slip clutch.

6. The system of claim 5 wherein the magnetic sensor comprises a Hall effect sensor and the trip portion comprises at least one magnetic member.

7. The system of claim 5 wherein the magnetic sensor comprises at least one magnetic reed switch and the trip portion comprises at least one magnetic member.

8. The system of claim 1 wherein the at least one sensor comprises at least one proximity sensor and the system includes at least one protrusion which is located to the output side of the rotatable slip clutch and moves therewith, the protrusion positioned for passing within a sensing field of the proximity sensor when aligned therewith.

9. The system of claim 1 wherein the at least one sensor comprises at least one contact switch and the system includes at least one protrusion which is located to the output side of the rotatable slip clutch and moves therewith, the protrusion positioned to engage the contact switch when aligned therewith.

10. The system of claim 1 wherein the at least one sensor comprises at least one optical sensor and the system includes a defined image area which is located to the output side of the rotatable slip clutch and moves therewith, the image area positioned for detection by the optical sensor when the image area is aligned with the optical sensor.

11. The warewasher jam detection system of claim 1 wherein the conveyor extends through a warewasher housing that defines a wash area and rinse area for wares traveling therethrough.

12. The warewasher jam detection system of claim 11, further comprising:

a controller associated with the sensor for receiving the output therefrom, the controller operable to identify a jam condition based upon the received output and, in response to identification of a jam condition, to stop the drive motor.

13. A warewasher jam detection system, comprising:

a conveyor drive arrangement including:

a drive motor assembly including a drive motor and an output shaft;

a rotatable slip clutch including an input side operatively connected for rotation by the drive motor assembly output shaft, an output side of the rotatable slip clutch operatively connected for driving a conveyor;

at least a first sensor and a second sensor each producing an output indicative of rotation/non-rotation of the output side of the rotatable slip clutch, with a defined spacing between the first and second sensors;

wherein the system includes first and second sensor tripping elements positioned to the output side of the rotatable slip clutch, each positioned for tripping the first and second sensor when aligned therewith respectively, a spacing between the first and second sensor tripping elements being different than the defined spacing of the first and second sensors for preventing simultaneous tripping of the first and second sensors.

14. The system of claim 13 wherein the sensors and the sensor tripping elements are selected from the group pairs consisting of (i) magnetic sensors and magnets, (ii) proximity sensors and protrusions, and (iii) optical sensors and image areas.

15. The system of claim 13 wherein the slip clutch is selected from the group consisting of a friction clutch, a sprag clutch, and a detent clutch.

16. The system of claim 13, further comprising:

a controller associated with the first and second sensors for receiving the outputs therefrom, the controller operable, based upon said received outputs, to identify a jam condition of the warewasher and, in response to identification of a jam condition, to stop the drive motor.

17. A warewasher jam detection system installable in a warewasher including a drive motor for driving a conveyor, the system comprising:

a slip clutch for positioning between the drive motor and the conveyor, the slip clutch including an input side and an output side;

at least one sensor for producing an output indicative of movement/non-movement of the output side of the slip clutch; and at least one sensor tripping element for tripping the sensor.

18. The system of claim 17 wherein the at least one sensor comprises at least a first sensor and a second sensor, with a defined spacing between the first and second sensors, wherein the at least one sensor tripping element includes first and second sensor tripping elements, each positioned for tripping the first and second sensor when aligned therewith respectively, a spacing between the first and second sensor tripping elements being different than the defined spacing of the first and second sensors for preventing simultaneous tripping of the first and second sensors.

19. The system of claim 17 wherein the sensor tripping element is located on a portion of the slip clutch.

20. The system of claim 17 wherein the sensor and the sensor tripping element are selected from the group pairs consisting of (i) a magnetic sensor and a magnetic member, (ii) a proximity sensor and a protrusion, and (iii) an optical sensor and an image area.

21. The warewasher jam detection system of claim 17, further comprising:

a controller associated with the sensor for receiving the output therefrom, the controller operable to identify a jam condition based upon the received output and, in response to identification of a jam condition, to stop the drive motor.

22. The system of claim 17 wherein the sensor tripping element repeatedly trips the sensor during relative movement between the sensor tripping element and the sensor.

23. A method of detecting a jam condition in a warewasher including a drive motor for driving a conveyor, the method comprising the steps of:

(a) providing a slip clutch between the drive motor and the conveyor, including an input side and an output side, (b) setting a slip threshold of the slip clutch at a level to identify jam conditions;

(c) providing a sensor arrangement for producing an output indicative of a movement state of the output side of the slip clutch; and (d) identifying a jam condition based upon the output produced in step (c).

24. The method of claim 23 wherein in step (c) at least first and second sensors are spaced a defined distance from each other to the output side of the slip clutch, and in step (a) at least first and second sensor tripping elements having a spacing which is different than the defined distance between the first and second sensors are positioned to the output side of the slip clutch.

25. The method of claim 24 wherein step (c) includes each of the first and second sensors producing sensor trip signals as the output side of the slip clutch moves, and step (d) involves identifying a jam condition when at least one of the sensors stops producing sensor trip signals.

26. The method of claim 24 wherein step (c) involves producing sensor trip signals as the output side of the clutch moves and step (d) involves monitoring a duration between successive sensor trip signals.

27. The method of claim 26 wherein step (d) involves identifying a jam condition if the monitored duration falls outside an established duration window.

28. The method of claim 27 comprising further steps of:

monitoring a drive speed of the warewasher and selecting the established duration window as a function of drive speed.

* * * * *

UNITED STATES PATENT AND TRADEMARK OFFICE

CERTIFICATE OF CORRECTION

PATENT NO. : 6,550,607 B1
DATED : April 22, 2003
INVENTOR(S) : Watson et al.

It is certified that error appears in the above-identified patent and that said Letters Patent is hereby corrected as shown below:

Column 10,
Line 3, "24" should be -- 23 --
Line 10, after the word "comprising" insert -- the --.

Signed and Sealed this

Fifth Day of August, 2003

JAMES E. ROGAN
*Director of the United States Patent and Trademark Office*